US007846884B2

(12) United States Patent
Ma

(10) Patent No.: US 7,846,884 B2
(45) Date of Patent: Dec. 7, 2010

(54) LUBRICATING OIL COMPOSITIONS

(75) Inventor: Qinggao Ma, Naugatuck, CT (US)

(73) Assignee: Chemtura Corporation, Middlebury, CT (US)

( * ) Notice: Subject to any disclaimer, the term of this patent is extended or adjusted under 35 U.S.C. 154(b) by 1030 days.

(21) Appl. No.: 11/599,883

(22) Filed: Nov. 14, 2006

(65) Prior Publication Data

US 2007/0123438 A1 May 31, 2007

Related U.S. Application Data

(60) Provisional application No. 60/740,410, filed on Nov. 29, 2005.

(51) Int. Cl.
*C10M 133/12* (2006.01)
*C10M 133/38* (2006.01)
*C07C 211/51* (2006.01)

(52) U.S. Cl. ..... 508/557; 508/110; 564/307

(58) Field of Classification Search ..... 508/557, 508/561, 562, 563, 110; 564/307
See application file for complete search history.

(56) References Cited

U.S. PATENT DOCUMENTS

| | | | | |
|---|---|---|---|---|
| 3,293,181 | A | 12/1966 | Stuart | |
| 3,396,109 | A | 8/1968 | Butler et al. | |
| 3,397,145 | A | 8/1968 | Cyba | |
| 3,442,804 | A | 5/1969 | Le Suer et al. | |
| 3,637,499 | A | 1/1972 | Pollak | |
| 4,072,654 | A | 2/1978 | Kline | |
| 5,498,809 | A | 3/1996 | Emert et al. | |
| 5,922,654 | A * | 7/1999 | Yamazaki et al. | 508/364 |
| 2002/0049145 | A1 * | 4/2002 | Cannon et al. | 508/491 |
| 2002/0132888 | A1 * | 9/2002 | Maender et al. | 524/83 |
| 2004/0077506 | A1 * | 4/2004 | Arrowsmith et al. | 508/185 |

FOREIGN PATENT DOCUMENTS

| | | |
|---|---|---|
| WO | WO 01/29126 | 4/2001 |
| WO | WO 02/42262 | 5/2002 |
| WO | WO 0246149 A2 | 6/2002 |
| WO | WO 2004/031287 | 4/2004 |

* cited by examiner

*Primary Examiner*—Glenn Caldarola
*Assistant Examiner*—Jim Goloboy
(74) *Attorney, Agent, or Firm*—Joseph Suhaddnik

(57) ABSTRACT

Lubricating oil compositions containing (a) at least one oil of lubricating viscosity and (b) an effective amount of at least one thio-functionalized phenylenediamine compound of the general formula:

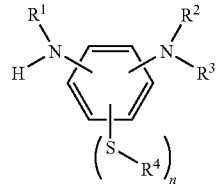

wherein $R^1$, $R^2$, $R^3$, $R^4$ and n are as defined herein are provided. Methods of operating an engine employing the lubricating oil composition are also provided.

14 Claims, No Drawings

LUBRICATING OIL COMPOSITIONS

PRIORITY

This application claims the benefit under 35 U.S.C. §119 to U.S. Provisional Application 60/740,410, filed on Nov. 29, 2005 and entitled "LUBRICATING OIL COMPOSITIONS", the contents of which are incorporated by reference herein.

BACKGROUND OF THE INVENTION

1. Technical Field

The present invention generally relates to lubricating oil compositions containing at least a thio-functionalized phenylenediamine as an antioxidant.

2. Description of the Related Art

Thio-functionalized phenylenediamine compounds are known. See, e.g., U.S. Pat. No. 4,072,654 and International Publication Nos. WO 02/42262 and WO 04/031287. These compounds are indicated as being useful as stabilizers for elastomers to prevent oxidative, thermal, dynamic, light-induced and/or ozone induced degradation. They are also indicated as being suitable as stabilizers for elastomers to prevent contact discoloration of substrates coming into contact with elastomers.

In developing lubricating oils, there have been many attempts to provide additives that impart, for example, antioxidant, antiwear, and deposit control properties thereto. Zinc dialkyldithiophosphates (ZDDP) have been used as antifatigue, antiwear, antioxidant, extreme pressure and friction modifying additives for lubricating oils for many years. However, they are subject to several drawbacks owing to their zinc and phosphorus contents. The presence of zinc contributes to the emission of particulates in the exhaust. In addition, during operation of an internal combustion engine, lubricating oil enters the combustion chambers by means such as clinging to cylinder walls as the piston makes its down stroke.

When phosphorus-containing lubricating oil compositions enter the combustion reaction, phosphorus enters the exhaust stream where it acts as a catalyst poison thus shortening the useful life of the catalytic converter. Moreover, zinc dialkyldithiophosphates give rise to ash, which contributes to particulate matter in automotive exhaust emissions, and regulatory agencies are seeking to reduce emissions of zinc into the environment. Thus, it is not only important to limit the particulate matter and pollution formed during engine use for toxicological and environmental reasons, but it is also important to maintain the antioxidant properties of the lubricating oil.

In view of the aforementioned shortcomings of the known zinc and phosphorus-containing additives, efforts have been made to provide lubricating oil additives that contain neither zinc nor phosphorus or, at least, contain them in substantially reduced amounts.

It would therefore be desirable to provide lubricating oil compositions having improved properties while also having a reduced content of zinc and phosphorous.

SUMMARY OF THE INVENTION

In accordance with one embodiment of the present invention, a lubricating oil composition is provided comprising (a) an oil of lubricating viscosity and (b) an effective amount of at least one thio-functionalized phenylenediamine compound of the general formula:

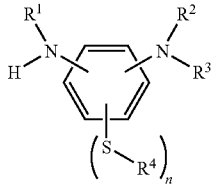

wherein $R^1$ is a straight or branched, substituted or unsubstituted, $C_1$-$C_{30}$ alkyl, a substituted or unsubstituted $C_3$-$C_{30}$ cycloalkyl, a substituted or unsubstituted $C_3$-$C_{30}$ cycloalkenyl, a substituted or unsubstituted $C_5$-$C_{30}$ aryl, a substituted or unsubstituted $C_5$-$C_{30}$ arylalkyl, a substituted or unsubstituted $C_5$-$C_{30}$ heteroaryl, a substituted or unsubstituted $C_3$-$C_{30}$ heterocyclic ring or a $C_1$-$C_{20}$ ester; $R^2$ and $R^3$ are independently hydrogen, a straight or branched, substituted or unsubstituted, $C_1$-$C_{30}$ alkyl, a substituted or unsubstituted $C_3$-$C_{30}$ cycloalkyl, a substituted or unsubstituted $C_3$-$C_{30}$ cycloalkenyl, a substituted or unsubstituted $C_5$-$C_{30}$ aryl, a substituted or unsubstituted $C_5$-$C_{30}$ arylalkyl, a substituted or unsubstituted $C_5$-$C_{30}$ heteroaryl, a substituted or unsubstituted $C_3$-$C_{30}$ heterocyclic ring or a $C_1$-$C_{20}$ ester with the proviso that only one of $R^2$ and $R^3$ can be hydrogen or $R^2$ and $R^3$ together with the nitrogen atom to which they are bonded are joined together to form a heterocyclic group optionally containing one or more additional heterocyclic atoms; $R^4$ is independently a straight or branched, substituted or unsubstituted, $C_1$-$C_{30}$ alkyl, a substituted or unsubstituted $C_3$-$C_{30}$ cycloalkyl, a substituted or unsubstituted $C_3$-$C_{30}$ cycloalkenyl, a substituted or unsubstituted $C_5$-$C_{30}$ aryl, a substituted or unsubstituted $C_5$-$C_{30}$ arylalkyl, a substituted or unsubstituted $C_5$-$C_{30}$ heteroaryl, a substituted or unsubstituted $C_3$-$C_{30}$ heterocyclic ring or a $C_1$-$C_{20}$ ester, and n is 1 or 2.

In accordance with a second embodiment of the present invention, a method of operating an internal combustion engine is provided comprising operating the internal combustion engine with a lubricating oil composition comprising (a) an oil of lubricating viscosity and (b) an effective amount of at least one thio-functionalized phenylenediamine compound of the general formula:

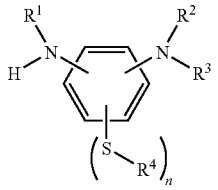

wherein $R^1$, $R^2$, $R^3$, $R^4$ and n have the aforestated meanings.

The present invention advantageously provides lubricating oil compositions containing thio-functionalized phenylenediamine compounds as an additive which provides deposit protection in addition to oxidation-corrosion protection. The lubricating oil compositions can also provide such protection while having relatively low levels of phosphorous, e.g., less than about 0.1%, preferably less than about 0.08% and more preferably less than about 0.05% by weight. Accordingly, the lubricating oil compositions of the present invention can be more environmentally desirable than the higher phosphorous lubricating oil compositions generally used in internal combustion engines because they facilitate longer catalytic converter life and activity while also providing the desired high deposit protection. This is due to the substantial absence of additives containing phosphorus compounds in these lubricating oil compositions. The thio-functionalized phenylenediamine compounds for use herein may also protect against oxidation both in the presence of transition metals such as, for example, iron (Fe) and copper (Cu), etc., as well as in a metal free environment.

DETAILED DESCRIPTION OF THE PREFERRED EMBODIMENTS

The lubricating oil compositions of this invention include as a first component an oil of lubricating viscosity. The oil of lubricating viscosity for use herein can be any presently known or later-discovered oil of lubricating viscosity used in formulating lubricating oil compositions for any and all such applications, e.g., engine oils, marine cylinder oils, functional fluids such as hydraulic oils, gear oils, transmission fluids, e.g., automatic transmission fluids, etc., turbine lubricants, compressor lubricants, metal-working lubricants, and other lubricating oil and grease compositions. Additionally, the oil of lubricating viscosity for use herein can optionally contain viscosity index improvers, e.g., polymeric alkylmethacrylates; olefinic copolymers, e.g., an ethylene-propylene copolymer or a styrene-butadiene copolymer; and the like and mixtures thereof. A preferred lubricating oil composition is an engine oil composition.

As one skilled in the art would readily appreciate, the viscosity of the oil of lubricating viscosity is dependent upon the application. Accordingly, the viscosity of an oil of lubricating viscosity for use herein will ordinarily range from about 2 to about 2000 centistokes (cSt) at 100° Centigrade (C). Generally, individually the oils used as engine oils will have a kinematic viscosity range at 100° C. of about 2 cSt to about 30 cSt, preferably about 3 cSt to about 16 cSt, and most preferably about 4 cSt to about 12 cSt and will be selected or blended depending on the desired end use and the additives in the finished oil to give the desired grade of engine oil, e.g., a lubricating oil composition having an SAE Viscosity Grade of 0W, 0W-20, 0W-30, 0W-40, 0W-50, 0W-60, 5W, 5W-20, 5W-30, 5W-40, 5W-50, 5W-60, 10W, 10W-20, 10W-30, 10W-40, 10W-50, 15W, 15W-20, 15W-30 or 15W-40. Oils used as gear oils can have viscosities ranging from about 2 cSt to about 2000 cSt at 100° C.

Base stocks may be manufactured using a variety of different processes including, but not limited to, distillation, solvent refining, hydrogen processing, oligomerization, esterification, and rerefining. Rerefined stock shall be substantially free from materials introduced through manufacturing, contamination, or previous use. The base oil of the lubricating oil compositions of this invention may be any natural or synthetic lubricating base oil. Suitable hydrocarbon synthetic oils include, but are not limited to, oils prepared from the polymerization of ethylene or from the polymerization of 1-olefins to provide polymers such as polyalphaolefin or PAO oils, or from hydrocarbon synthesis procedures using carbon monoxide and hydrogen gases such as in a Fisher-Tropsch process. For example, a suitable oil of lubricating viscosity is one that comprises little, if any, heavy fraction; e.g., little, if any, lube oil fraction of viscosity about 20 cSt or higher at 100° C.

The oil of lubricating viscosity may be derived from natural lubricating oils, synthetic lubricating oils or mixtures thereof. Suitable oils includes base stocks obtained by isomerization of synthetic wax and slack wax, as well as hydrocracked base stocks produced by hydrocracking (rather than solvent extracting) the aromatic and polar components of the crude. Suitable oils include those in all API categories I, II, III, IV and V as defined in API Publication 1509, 14th Edition, Addendum I, December 1998. Group IV base oils are polyalphaolefins (PAO). Group V base oils include all other base oils not included in Group I, II, III, or IV. Although Group II, III and IV base oils are preferred for use in this invention, these preferred base oils may be prepared by combining one or more of Group I, II, III, IV and V base stocks or base oils.

Useful natural oils include mineral lubricating oils such as, for example, liquid petroleum oils, solvent-treated or acid-treated mineral lubricating oils of the paraffinic, naphthenic or mixed paraffinic-naphthenic types, oils derived from coal or shale, animal oils, vegetable oils (e.g., rapeseed oils, castor oils and lard oil), and the like.

Useful synthetic lubricating oils include, but are not limited to, hydrocarbon oils and halo-substituted hydrocarbon oils such as polymerized and interpolymerized olefins, e.g., polybutylenes, polypropylenes, propylene-isobutylene copolymers, chlorinated polybutylenes, poly(1-hexenes), poly(1-octenes), poly(1-decenes), and the like and mixtures thereof; alkylbenzenes such as dodecylbenzenes, tetradecylbenzenes, dinonylbenzenes, di(2-ethylhexyl)-benzenes, and the like; polyphenyls such as biphenyls, terphenyls, alkylated polyphenyls, and the like; alkylated diphenyl ethers and alkylated diphenyl sulfides and the derivative, analogs and homologs thereof and the like.

Other useful synthetic lubricating oils include, but are not limited to, oils made by polymerizing olefins of less than 5 carbon atoms such as ethylene, propylene, butylenes, isobutene, pentene, and mixtures thereof. Methods of preparing such polymer oils are well known to those skilled in the art.

Additional useful synthetic hydrocarbon oils include liquid polymers of alpha olefins having the proper viscosity. Especially useful synthetic hydrocarbon oils are the hydrogenated liquid oligomers of $C_6$ to $C_{12}$ alpha olefins such as, for example, 1-decene trimer.

Another class of useful synthetic lubricating oils includes, but is not limited to, alkylene oxide polymers, i.e., homopolymers, interpolymers, and derivatives thereof where the terminal hydroxyl groups have been modified by, for example, esterification or etherification. These oils are exemplified by the oils prepared through polymerization of ethylene oxide or propylene oxide, the alkyl and phenyl ethers of these polyoxyalkylene polymers (e.g., methyl poly propylene glycol ether having an average molecular weight of about 1,000, diphenyl ether of polyethylene glycol having a molecular weight of about 500 to about 1000, diethyl ether of polypropylene glycol having a molecular weight of about 1,000 to about 1,500, etc.) or mono- and polycarboxylic esters thereof such as, for example, the acetic esters, mixed $C_3$-$C_8$ fatty acid esters, or the $C_{13}$oxo acid diester of tetraethylene glycol.

Yet another class of useful synthetic lubricating oils include, but are not limited to, the esters of dicarboxylic acids e.g., phthalic acid, succinic acid, alkyl succinic acids, alkenyl succinic acids, maleic acid, azelaic acid, suberic acid, sebacic acid, fumaric acid, adipic acid, linoleic acid dimer, malonic acids, alkyl malonic acids, alkenyl malonic acids, etc., with a variety of alcohols, e.g., butyl alcohol, hexyl alcohol, dodecyl alcohol, 2-ethylhexyl alcohol, ethylene glycol, diethylene glycol monoether, propylene glycol, etc. Specific examples of these esters include dibutyl adipate, di(2-ethylhexyl)sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, the complex ester formed by reacting one mole of sebacic acid with two moles of tetraethylene glycol and two moles of 2-ethylhexanoic acid and the like.

Esters useful as synthetic oils also include, but are not limited to, those made from carboxylic acids having from about 5 to about 12 carbon atoms with alcohols, e.g., methanol, ethanol, etc., polyols and polyol ethers such as neopentyl glycol, trimethylol propane, pentaerythritol, dipentaerythritol, tripentaerythritol, and the like.

Silicon-based oils such as, for example, polyalkyl-, polyaryl-, polyalkoxy- or polyaryloxy-siloxane oils and silicate oils, comprise another useful class of synthetic lubricating oils. Specific examples of these include, but are not limited to, tetraethyl silicate, tetra-isopropyl silicate, tetra-(2-ethylhexyl) silicate, tetra-(4-methyl-hexyl)silicate, tetra-(p-tert-butylphenyl)silicate, hexyl-(4-methyl-2-pentoxy)disiloxane, poly(methyl)siloxanes, poly(methylphenyl)siloxanes, and the like. Still yet other useful synthetic lubricating oils include, but are not limited to, liquid esters of phosphorous containing acids, e.g., tricresyl phosphate, trioctyl phosphate, diethyl ester of decane phosphionic acid, etc., polymeric tetrahydrofurans and the like.

The oil of lubricating viscosity may be derived from unrefined, refined and rerefined oils, either natural, synthetic or mixtures of two or more of any of these of the type disclosed hereinabove. Unrefined oils are those obtained directly from a natural or synthetic source (e.g., coal, shale, or tar sands bitumen) without further purification or treatment. Examples of unrefined oils include, but are not limited to, a shale oil obtained directly from retorting operations, a petroleum oil obtained directly from distillation or an ester oil obtained directly from an esterification process, each of which is then used without further treatment. Refined oils are similar to the unrefined oils except they have been further treated in one or more purification steps to improve one or more properties. These purification techniques are known to those of skill in the art and include, for example, solvent extractions, secondary distillation, acid or base extraction, filtration, percolation, hydrotreating, dewaxing, etc. Rerefined oils are obtained by treating used oils in processes similar to those used to obtain refined oils. Such rerefined oils are also known as reclaimed or reprocessed oils and often are additionally processed by techniques directed to removal of spent additives and oil breakdown products.

Lubricating oil base stocks derived from the hydroisomerization of wax may also be used, either alone or in combination with the aforesaid natural and/or synthetic base stocks. Such wax isomerate oil is produced by the hydroisomerization of natural or synthetic waxes or mixtures thereof over a hydroisomerization catalyst.

Natural waxes are typically the slack waxes recovered by the solvent dewaxing of mineral oils; synthetic waxes are typically the wax produced by the Fischer-Tropsch process.

The oil of lubricating viscosity for use in the lubricating oil compositions may be present in a major amount, e.g., an amount of greater than 50 wt. %, preferably greater than about 70 wt. %, more preferably from about 80 to about 99.5 wt. % and most preferably from about 85 to about 98 wt. %, based on the total weight of the composition.

The one or more thio-functionalized phenylenediamine compounds for incorporating into the oil of lubricating viscosity to form the lubricating oil compositions of the present invention can be represented by the general formula:

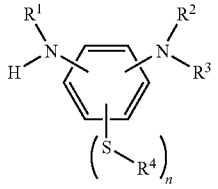

wherein $R^1$ is a straight or branched, substituted or unsubstituted, $C_1$-$C_{30}$ alkyl, a substituted or unsubstituted $C_3$-$C_{30}$ cycloalkyl, a substituted or unsubstituted $C_3$-$C_{30}$ cycloalkenyl, a substituted or unsubstituted $C_5$-$C_{30}$ aryl, a substituted or unsubstituted $C_5$-$C_{30}$ arylalkyl, a substituted or unsubstituted $C_5$-$C_{30}$ heteroaryl, a substituted or unsubstituted $C_3$-$C_{30}$ heterocyclic ring or a $C_1$-$C_{20}$ ester; $R^2$ and $R^3$ are independently hydrogen, a straight or branched, substituted or unsubstituted, $C_1$-$C_{30}$ alkyl, a substituted or unsubstituted $C_3$-$C_{30}$ cycloalkyl, a substituted or unsubstituted $C_3$-$C_{30}$ cycloalkenyl, a substituted or unsubstituted $C_5$-$C_{30}$ aryl, a substituted or unsubstituted $C_5$-$C_{30}$ arylalkyl, a substituted or unsubstituted $C_5$-$C_{30}$ heteroaryl, a substituted or unsubstituted $C_3$-$C_{30}$ heterocyclic ring or a $C_1$-$C_{20}$ ester with the proviso that only one of $R^2$ and $R^3$ can be hydrogen or $R^2$ and $R^3$ together with the nitrogen atom to which they are bonded are joined together to form a heterocyclic group optionally containing one or more additional heterocyclic atoms; $R^4$ is independently a straight or branched, substituted or unsubstituted, $C_1$-$C_{30}$ alkyl, a substituted or unsubstituted $C_3$-$C_{30}$ cycloalkyl, a substituted or unsubstituted $C_3$-$C_{30}$ cycloalkenyl, a substituted or unsubstituted $C_5$-$C_{30}$ aryl, a substituted or unsubstituted $C_5$-$C_{30}$ arylalkyl, a substituted or unsubstituted $C_5$-$C_{30}$ heteroaryl, a substituted or unsubstituted $C_3$-$C_{30}$ heterocyclic ring or a $C_1$-$C_{20}$ ester, and n is 1 or 2. In one embodiment, the nitrogen groups, i.e., $NHR^1$ and $NR^2R^3$, are bonded to the aromatic ring in the para position with respect to one another.

Representative examples of alkyl groups for use herein include, by way of example, a straight or branched hydrocarbon chain radical containing carbon and hydrogen atoms of from 1 to about 30 carbon atoms, preferably from 1 to about 12 carbon atoms and most preferably from 1 to about 6 carbon atoms, with or without unsaturation, to the rest of the molecule, e.g., methyl, ethyl, n-propyl, 1-methylethyl (isopropyl), n-butyl, n-pentyl, 1,1-dimethylethyl (t-butyl), and the like.

Representative examples of ester groups for use herein include, by way of example, a carboxylic acid ester having one to 20 carbon atoms and the like.

Representative examples of ether or polyether containing groups for use herein include, by way of example, —O—, alkylene oxides, polyalkylene oxides and the like, e.g., ethylene oxide, propylene oxide, butylene oxide, polyethylene oxides, polypropylene oxides, polybutylene oxides and the like.

Representative examples of cycloalkyl groups for use herein include, by way of example, a substituted or unsubstituted non-aromatic mono or multicyclic ring system of about 3 to about 12 carbon atoms such as, for example, cyclopropyl, cyclobutyl, cyclopentyl, cyclohexyl, perhydronapththyl, adamantyl and norbornyl groups bridged cyclic group or spriro-bicyclic groups, e.g., sprio (4,4) non-2-yl and the like.

Representative examples of cycloalkenyl groups for use herein include, by way of example, a substituted or unsubstituted cyclic ring-containing radicals containing in the range of about 3 up to about 12 carbon atoms with at least one carbon-carbon double bond, e.g., cyclopropenyl, cyclobutenyl, cyclopentenyl and the like.

Representative examples of aryl groups for use herein include, by way of example, a substituted or unsubstituted aromatic radical having in the range of about 5 up to about 30 carbon atoms, e.g., phenyl, naphthyl, tetrahydronapthyl, indenyl, biphenyl and the like.

Representative examples of arylalkyl groups for use herein include, by way of example, a substituted or unsubstituted aryl group as defined above directly bonded to an alkyl group as defined above, e.g., —$CH_2C_6H_5$, —$C_2H_5C_6H_5$ and the like.

Representative examples of heterocyclic ring groups for use herein include, by way of example, a substituted or unsubstituted stable 3 to about 15 membered ring radical, containing carbon atoms and from one to five heteroatoms, e.g., nitrogen, phosphorus, oxygen, sulfur and mixtures thereof. Suitable heterocyclic ring radicals for use herein may be a monocyclic, bicyclic or tricyclic ring system, which may include fused, bridged or spiro ring systems, and the nitrogen, phosphorus, carbon, oxygen or sulfur atoms in the heterocyclic ring radical may be optionally oxidized to various oxidation states. In addition, the nitrogen atom may be optionally quaternized; and the ring radical may be partially or fully saturated (i.e., heteroaromatic or heteroaryl aromatic).

Examples of such heterocyclic ring radicals include, but are not limited to, azetidinyl, acridinyl, benzodioxolyl, benzodioxanyl, benzofurnyl, carbazolyl, cinnolinyl, dioxolanyl, indolizinyl, naphthyridinyl, perhydroazepinyl, phenazinyl, phenothiazinyl, phenoxazinyl, phthalazinyl, pyridyl, pteridinyl, purinyl, quinazolinyl, quinoxalinyl, quinolinyl, isoquinolinyl, tetrazoyl, imidazolyl, tetrahydroisouinolyl, piperidinyl, piperazinyl, 2-oxopiperazinyl, 2-oxopiperidinyl, 2-oxopyrrolidinyl, 2-oxoazepinyl, azepinyl, pyrrolyl, 4-piperidonyl, pyrrolidinyl, pyrazinyl, pyrimidinyl, pyridazinyl, oxazolyl, oxazolinyl, oxasolidinyl, triazolyl, indanyl, isoxazolyl, isoxasolidinyl, morpholinyl, thiazolyl, thiazolinyl, thiazolidinyl, isothiazolyl, quinuclidinyl, isothiazolidinyl, indolyl, isoindolyl, indolinyl, isoindolinyl, octahydroindolyl, octahydroisoindolyl, quinolyl, isoquinolyl, decahydroisoquinolyl, benzimidazolyl, thiadiazolyl, benzopyranyl, benzothiazolyl, benzooxazolyl, furyl, tetrahydrofurtyl, tetrahydropyranyl, thienyl, benzothienyl, thiamorpholinyl, thiamorpholinyl sulfoxide, thiamorpholinyl sulfone, dioxaphospholanyl, oxadiazolyl, chromanyl, isochromanyl and the like and mixtures thereof.

Representative examples of heteroaryl groups for use herein include, by way of example, a substituted or unsubstituted heterocyclic ring radical as defined above. The heteroaryl ring radical may be attached to the main structure at any heteroatom or carbon atom that results in the creation of a stable structure.

The substituents in the 'substituted alkyl', 'substituted cycloalkyl', 'substituted cycloalkenyl', 'substituted arylalkyl', 'substituted aryl', 'substituted heterocyclic ring', 'substituted heteroaryl ring', and 'substituted cyclic ring' may be the same or different and include, by way of example, hydrogen, hydroxy, halogen, carboxyl, cyano, nitro, oxo (=O), substituted or unsubstituted alkyl, substituted or unsubstituted alkoxy, substituted or unsubstituted alkenyl, substituted or unsubstituted alkynyl, substituted or unsubstituted aryl, substituted or unsubstituted arylalkyl, substituted or unsubstituted cycloalkyl, substituted or unsubstituted cycloalkenyl, substituted or unsubstituted amino, substituted or unsubstituted aryl, substituted or unsubstituted heteroaryl, substituted heterocyclylalkyl ring, substituted or unsubstituted heteroarylalkyl, substituted or unsubstituted heterocyclic ring, substituted or unsubstituted guanidine, —$COOR_x$, —$C(O)R_x$, —$C(S)R_x$, —$C(O)NR_xR_y$, —$C(O)ONR_xR_y$, —$NR_xCONR_yR_z$, —$N(R_x)SOR_y$, —$N(R_x)SO_2R_y$, —(=N—N(Rx)$R_y$), —$NR_xC(O)OR_y$, —$NR_xR_y$, —$NR_xC(O)R_y$—, —$NR_xC(S)R_y$—$NR_xC(S)NR_yR_z$, —$SONR_xR_y$—, —$SO_2NR_xR_y$—, —$OR_x$, —$OR_xC(O)NR_yR_z$, —$OR_xC(O)OR_y$—, —$OC(O)R_x$, —$OC(O)NR_xR_y$, —$R_xNR_yC(O)R_z$, —$R_xOR_y$, —$R_xC(O)OR_y$, —$R_xC(O)NR_yR_z$, —$R_xC(O)R_x$, —$R_xOC(O)R_y$, —$SR_x$, —$SOR_x$, —$SO_2R_x$, —$ONO_2$, wherein $R_x$, $R_y$ and $R_z$ in each of the above groups can be the same or different and can be a hydrogen atom, substituted or unsubstituted alkyl, substituted or unsubstituted alkoxy, substituted or unsubstituted alkenyl, substituted or unsubstituted alkynyl, substituted or unsubstituted aryl, substituted or unsubstituted arylalkyl, substituted or unsubstituted cycloalkyl, substituted or unsubstituted cycloalkenyl, substituted or unsubstituted amino, substituted or unsubstituted aryl, substituted or unsubstituted heteroaryl, 'substituted heterocyclylalkyl ring' substituted or unsubstituted heteroarylalkyl, substituted or unsubstituted heterocyclic ring and the like.

Useful amines in which $R^2$ and $R^3$ together with the nitrogen atom to which they are bonded are joined together to form a heterocyclic ring include cyclic amines such as pyrrolidine, piperidine, piperazine, morpholine, and the like.

Many of the thio-functionalized phenylenediamine compounds and their derivatives are known and can be obtained by known methods. See, e.g., U.S. Pat. No. 4,072,654, and International Publication Nos. WO 02/42262 and WO 04/031287. For example, the thio-functionalized phenylenediamine compounds for use herein can be obtained by (a) reacting a phenylenediamine of the general formula

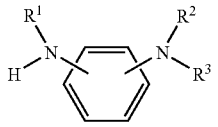

wherein $R^1$, $R^2$ and $R^3$ have the aforestated meanings with an oxide adsorbent; and (b) reacting the product of step (a) with a sufficient amount of thiol of the general formula H—S—$R^4$ wherein $R^4$ has the aforestated meaning, to form the thio-functionalized phenylenediamine compounds. This reaction is generally set forth below in Scheme I:

SCHEME I

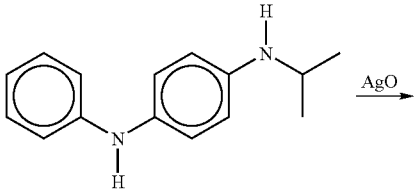

-continued

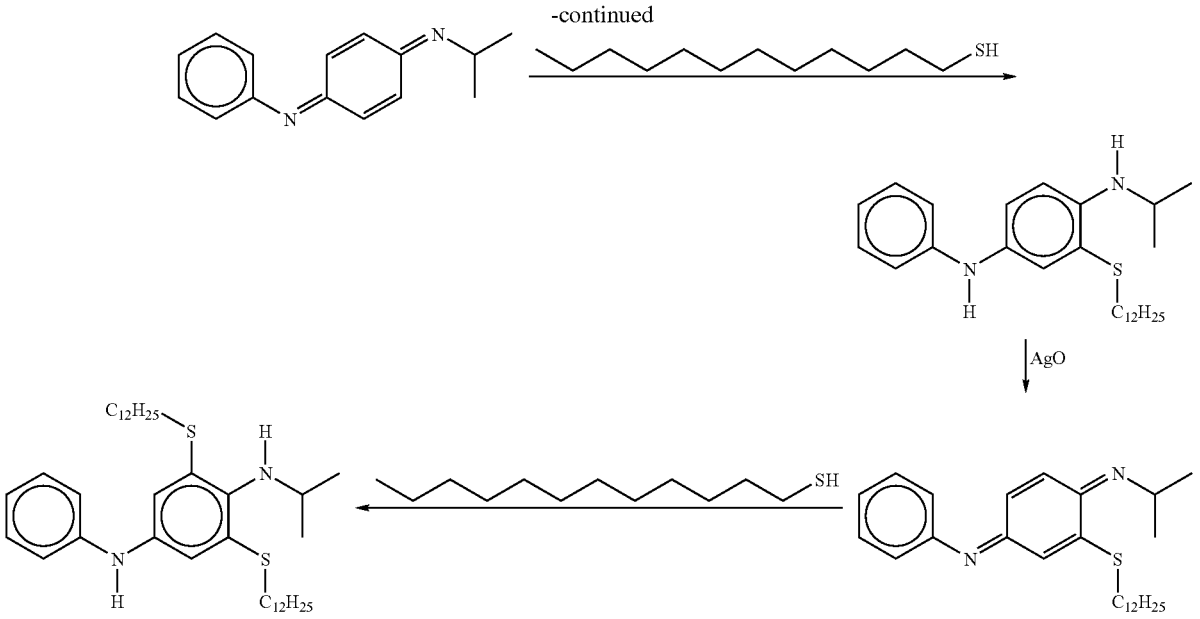

Suitable oxide adsorbents include, but are not limited to, metal oxides such as, for example, $MnO_2$, AgO and $Fe_2O_3$, and the like and mixtures thereof.

The reaction can ordinarily be carried out at room temperature and for a time period sufficient to form the thio-functionalized phenylenediamine compounds. If desired, the reaction can take place in the presence of a solvent. Suitable solvents include, but are not limited to, aliphatic hydrocarbon solvents, aromatic hydrocarbon solvents, halogenated hydrocarbon solvents, alcohols, ethers, ketones and the like and mixtures thereof. Examples of suitable solvents include, hexane, toluene, benzene, xylene, methylene chloride, chloroform, polyethylene glycol ethers, acetone, methyl-ethyl-ketone, methyl-isobutyl-ketone and the like and mixtures thereof.

The thio-functionalized phenylenediamine compounds for use in the lubricating oil compositions of this invention can be used as a complete or partial replacement for commercially available antioxidants currently used in lubricant formulations and can be in combination with other additives typically found in motor oils. Generally, the thio-functionalized phenylenediamine compounds can be present in the lubricating oil compositions in an amount ranging from about 0.05 to about 30 wt. % and preferably from about 0.1 to about 10 wt. %, based on the total weight of the composition. When used in combination with other types of antioxidants or additives used in oil formulations, synergistic and/or additive performance effects may be obtained with respect to improved antioxidancy, antiwear, frictional and detergency and high temperature engine deposit properties. Such other additives can be any presently known or later-discovered additives used in formulating lubricating oil compositions. The lubricating oil additives typically found in lubricating oils are, for example, dispersants, detergents, corrosion/rust inhibitors, antioxidants, anti-wear agents, anti-foamants, friction modifiers, seal swell agents, emulsifiers, VI improvers, pour point depressants, and the like. See, for example, U.S. Pat. No. 5,498,809 for a description of useful lubricating oil composition additives, the disclosure of which is incorporated herein by reference in its entirety.

Examples of dispersants include polyisobutylene succinimides, polyisobutylene succinate esters, Mannich Base ashless dispersants, and the like. Examples of detergents include metallic and ashless alkyl phenates, metallic and ashless sulfurized alkyl phenates, metallic and ashless alkyl sulfonates, metallic and ashless alkyl salicylates, metallic and ashless saligenin derivatives, and the like.

Examples of other antioxidants include alkylated diphenylamines, N-alkylated phenylenediamines, phenyl-naphthylamine, alkylated phenyl-naphthylamine, dimethyl quinolines, trimethyldihydroquinolines and oligomeric compositions derived therefrom, hindered phenolics, alkylated hydroquinones, hydroxylated thiodiphenyl ethers, alkylidenebisphenols, thiopropionates, metallic dithiocarbamates, 1,3,4-dimercaptothiadiazole and derivatives, oil soluble copper compounds, and the like. Representative examples of such additives are those commercially available from such sources as Chemtura Corporation and include, for example, Naugalube® 438, Naugalube 438L, Naugalube 640, Naugalube 635, Naugalube 680, Naugalube AMS, Naugalube APAN, Naugard PANA, Naugalube TMQ, Naugalube 531, Naugalube 431, Naugard® BHT, Naugalube 403, Naugalube 420 and the like.

Examples of anti-wear additives that can be used in combination with the additives of the present invention include organo borates, organo phosphites, organo phosphates, organic sulfur-containing compounds, sulfurized olefins, sulfurized fatty acid derivatives (esters), chlorinated paraffins, zinc dialkyldithiophosphates, zinc diaryldithiophosphates, dialkyldithiophosphate esters, diaryl dithiophosphate esters, phosphosulfurized hydrocarbons, and the like. Representative examples of such additives are those commercially available from The Lubrizol Corporation such as Lubrizol 677A, Lubrizol 1095, Lubrizol 1097, Lubrizol 1360, Lubrizol 1395, Lubrizol 5139, Lubrizol 5604 and the like, and from Ciba Corporation such as Irgalube 353 and the like.

Examples of friction modifiers include fatty acid esters and amides, organo molybdenum compounds, molybdenum dialkyldithiocarbamates, molybdenum dialkyl dithiophosphates, molybdenum disulfide, tri-molybdenum cluster dialkyldithiocarbamates, non-sulfur molybdenum compounds and the like. Representative examples of such friction modifiers are those commercially available from R.T. Vanderbilt Company, Inc. such as Molyvan A, Molyvan L, Molyvan 807, Molyvan 856B, Molyvan 822, Molyvan 855, and the like; Asahi Denka Kogyo K.K. such as SAKURA-LUBE 100, SAKURA-LUBE 165, SAKURA-LUBE 300, SAKURA-LUBE 310G, SAKURA-LUBE 321, SAKURA-LUBE 474, SAKURA-LUBE 600, SAKURA-LUBE 700, and the like; and from Akzo Nobel Chemicals GmbH such as Ketjen-Ox 77M, Ketjen-Ox 77TS, and the like.

An example of an anti-foam agent is polysiloxane, and the like. Examples of rust inhibitors are polyoxyalkylene polyol, benzotriazole derivatives, and the like. Examples of VI improvers include olefin copolymers and dispersant olefin copolymers, and the like. An example of a pour point depressant is polymethacrylate, and the like.

As noted above, suitable anti-wear compounds include dihydrocarbyl dithiophosphates. Preferably, the hydrocarbyl groups contain an average of at least 3 carbon atoms. Particularly useful are metal salts of at least one dihydrocarbyl dithiophosphoric acid wherein the hydrocarbyl groups contain an average of at least 3 carbon atoms. The acids from which the dihydrocarbyl dithiophosphates can be derived can be illustrated by acids of the formula:

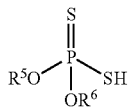

wherein $R^5$ and $R^6$ are the same or different and can be linear or branched alkyl, cycloalkyl, aralkyl, alkaryl, or substituted substantially hydrocarbyl radical derivatives of any of the above groups, and wherein the $R^5$ and $R^6$ groups in the acid each have, on average, at least 3 carbon atoms. By "substantially hydrocarbyl" is meant radicals containing substituent groups, e.g., 1 to 4 substituent groups per radical moiety such as, for example, ether, ester, thio, nitro, or halogen, that do not materially affect the hydrocarbon character of the radical.

Specific examples of suitable $R^5$ and $R^6$ radicals include isopropyl, isobutyl, n-butyl, sec-butyl, n-hexyl, heptyl, 2-ethylhexyl, diisobutyl, isooctyl, decyl, dodecyl, tetradecyl, hexadecyl, octadecyl, butylphenyl, o,p-dipentylphenyl, octylphenyl, polyisobutene-(molecular weight 350)-substituted phenyl, tetrapropylene-substituted phenyl, beta-octylbutylnaphthyl, cyclopentyl, cyclohexyl, phenyl, chlorophenyl, o-dichlorophenyl, bromophenyl, naphthenyl, 2-methylcyclohexyl, benzyl, chlorobenzyl, chloropentyl, dichlorophenyl, nitrophenyl, dichlorodecyl and xenyl radicals. Alkyl radicals having from about 3 to about 30 carbon atoms and aryl radicals having from about 6 to about 30 carbon atoms are preferred. Particularly preferred $R^5$ and $R^6$ radicals are alkyl of from 4 to about 18 carbon atoms.

The phosphorodithioic acids are readily obtainable by the reaction of a phosphorus pentasulfide and an aliphatic alcohol and/or phenol. The reaction involves at least mixing, at a temperature ranging from about 20° C. to about 200° C., about 4 moles of the alcohol or phenol with one mole of phosphorus pentasulfide. Hydrogen sulfide can be liberated as the reaction takes place. Mixtures of alcohols, phenols, or both can be employed, e.g., mixtures of $C_3$ to $C_{30}$ alcohols, $C_6$ to $C_{30}$ aromatic alcohols, etc. The metals useful to make the phosphate salts include, but are not limited to, Group I metals, Group II metals, aluminum, lead, tin, molybdenum, manganese, cobalt, and nickel with zinc being the preferred metal. Examples of metal compounds that can be reacted with the acid include lithium oxide, lithium hydroxide, lithium carbonate, lithium pentylate, sodium oxide, sodium hydroxide, sodium carbonate, sodium methylate, sodium propylate, sodium phenoxide, potassium oxide, potassium hydroxide, potassium carbonate, potassium methylate, silver oxide, silver carbonate, magnesium oxide, magnesium hydroxide, magnesium carbonate, magnesium ethylate, magnesium propylate, magnesium phenoxide, calcium oxide, calcium hydroxide, calcium carbonate, calcium methylate, calcium propylate, calcium pentylate, zinc oxide, zinc hydroxide, zinc carbonate, zinc propylate, strontium oxide, strontium hydroxide, cadmium oxide, cadmium hydroxide, cadmium carbonate, cadmium ethylate, barium oxide, barium hydroxide, barium hydrate, barium carbonate, barium ethylate, barium pentylate, aluminum oxide, aluminum propylate, lead oxide, lead hydroxide, lead carbonate, tin oxide, tin butylate, cobalt oxide, cobalt hydroxide, cobalt carbonate, cobalt pentylate, nickel oxide, nickel hydroxide, nickel carbonate and the like and mixtures thereof.

In some instances, the incorporation of certain ingredients, particularly carboxylic acids or metal carboxylates, e.g., small amounts of the metal acetate or acetic acid, used in conjunction with the metal reactant will facilitate the reaction and result in an improved product. For example, the use of up to about 5% of zinc acetate in combination with the required amount of zinc oxide facilitates the formation of a zinc phosphorodithioate.

The preparation of metal phosphorodithioates is well known in the art. See, e.g., U.S. Pat. Nos. 3,293,181; 3,397,145; 3,396,109; and 3,442,804; the disclosures of which are hereby incorporated by reference. Also useful as anti-wear additives are amine derivatives of dithiophosphoric acid compounds, such as are described in U.S. Pat. No. 3,637,499, the disclosure of which is hereby incorporated by reference in its entirety.

The zinc salts are most commonly used as anti-wear additives in lubricating oils in amounts ranging from about 0.1 to about 10 wt. %, preferably about 0.2 to about 2 wt. %, based upon the total weight of the lubricating oil composition. They may be prepared in accordance with known techniques, e.g., by first forming a dithiophosphoric acid, usually by reaction of an alcohol and/or a phenol with $P_2S_5$ and then neutralizing the dithiophosphoric acid with a suitable zinc compound.

Mixtures of alcohols can be used, including mixtures of primary and secondary alcohols, secondary generally for imparting improved antiwear properties and primary for thermal stability. In general, any basic or neutral zinc compound could be used, but the oxides, hydroxides, and carbonates are most generally employed. Commercial additives frequently contain an excess of zinc owing to use of an excess of the basic zinc compound in the neutralization reaction.

The zinc dihydrocarbyl dithiophosphates (ZDDP) are oil soluble salts of dihydrocarbyl esters of dithiophosphoric acids and can be represented by the following formula:

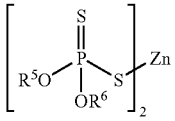

wherein $R^5$ and $R^6$ have the aforestated meanings.

The lubricating oil compositions of the present invention, when they contain these additives, are typically blended into a base oil in amounts such that the additives therein are effective to provide their normal attendant functions. Representative effective amounts of such additives are illustrated in Table 1.

TABLE 1

| Additives | Preferred Weight % | More Preferred Weight % |
|---|---|---|
| V.I. Improver | about 1 to about 12 | about 1 to about 4 |
| Corrosion Inhibitor | about 0.01 to about 3 | about 0.01 to about 1.5 |
| Oxidation Inhibitor | about 0.01 to about 5 | about 0.01 to about 1.5 |
| Dispersant | about 0.1 to about 10 | about 0.1 to about 5 |
| Lube Oil Flow Improver | about 0.01 to about 2 | about 0.01 to about 1.5 |
| Detergent/Rust Inhibitor | about 0.01 to about 6 | about 0.01 to about 3 |
| Pour Point Depressant | about 0.01 to about 1.5 | about 0.01 to about 0.5 |
| Anti-foaming Agents | about 0.001 to about 0.1 | about 0.001 to about 0.01 |
| Anti-wear Agents | about 0.001 to about 5 | about 0.001 to about 1.5 |
| Seal Swell Agents | about 0.1 to about 8 | about 0.1 to about 4 |
| Friction Modifiers | about 0.01 to about 3 | about 0.01 to about 1.5 |
| Lubricating Base Oil | Balance | Balance |

When other additives are employed, it may be desirable, although not necessary, to prepare additive concentrates comprising concentrated solutions or dispersions of the one or more thio-functionalized phenylenediamine compounds of this invention (in concentrate amounts hereinabove described), together with one or more other additives (the concentrate when constituting an additive mixture being referred to herein as an additive-package) whereby several additives can be added simultaneously to the base oil to form the lubricating oil composition. Dissolution of the additive concentrate into the lubricating oil can be facilitated by, for example, solvents and by mixing accompanied by mild heating, but this is not essential.

The concentrate or additive-package will typically be formulated to contain the additives in proper amounts to provide the desired concentration in the final formulation when the additive-package is combined with a predetermined amount of base lubricant. Thus, the subject additives of the present invention can be added to small amounts of base oil or other compatible solvents along with other desirable additives to form additive-packages containing active ingredients in collective amounts of, typically, from about 2.5 to about 90 percent, preferably from about 15 to about 75 percent, and more preferably from about 25 percent to about 60 percent by weight additives in the appropriate proportions with the remainder being base oil. The final formulations can typically employ about 1 to 20 weight percent of the additive-package with the remainder being base oil.

All of the weight percentages expressed herein (unless otherwise indicated) are based on the active ingredient (AI) content of the additive, and/or upon the total weight of any additive-package, or formulation, which will be the sum of the AI weight of each additive plus the weight of total oil or diluent.

In general, the lubricating oil compositions of the present invention can contain the additives in a concentration ranging from about 0.05 to about 30 weight percent. A concentration range for the additives ranging from about 0.1 to about 10 weight percent based on the total weight of the oil composition is preferred. A more preferred concentration range is from about 0.2 to about 5 weight percent. In one embodiment, oil concentrates of the additives can contain from about 1 to about 75 weight percent of the additive in a carrier or diluent oil of lubricating oil viscosity.

The following non-limiting examples are illustrative of the present invention.

Example 1

This example illustrates the preparation of a compound having the formula

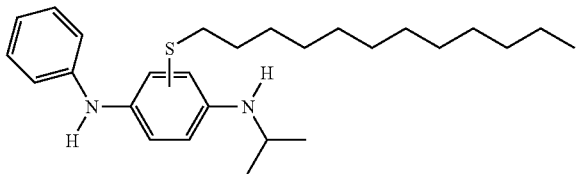

30.0 grams N-isopropyl-N'-phenyl-p-phenylenediamine (132.56 mmol, 1.00 eq.) was added under ambient condition to a 250 mL round bottom flask followed by 30.0 gram AgO (242.19 mmol, 1.83 eq.) and 150 mL acetone. The reaction was exothermic. After 24 hours, the mixture was filtered to remove all solid and 10 mL acetone was used to wash the residue solid. 26.0 Grams dodecylthiol (128.46 mmol, 0.97 eq.) was then added to the mixture. The reaction was stirred for 24 hours at room temperature and the solvent was removed via vacuum distillation. The resulting compound was purified using flash column chromatograph on silica gel using hexane as eluent to give the product as light brownish liquid.

Formula: $C_{27}H_{42}N_2S$, Mn=426.70

Yield: 48.0 gram, 81%

Example 2

Preparation of a Lubricating Oil Composition

To a motor oil formulation was blended 0.4 weight percent of the thio-functionalized phenylenediamine of Example 1 and an additional 0.1 wt. % of Solvent Neutral 150 base oil along with 50 ppm ferric naphthenate to form a lubricating oil composition. The motor oil formulation is set forth in Table 2.

TABLE 2

| Motor Oil Formulation (Base Blend) | |
|---|---|
| Ingredient | wt % |
| Solvent Neutral 150 | 83.85 |
| Zinc Dialkyldithiophosphate | 1.01 |
| Succinimide Dispersant | 7.58 |
| Overbased Calcium Sulfonate Detergent | 1.31 |
| Neutral Calcium Sulfonate Detergent | 0.5 |
| Antioxidant | 0.0 |
| Rust Inhibitor | 0.1 |
| Four Point Depressant | 0.1 |
| OCP VI Improver | 5.55 |

Comparative Example A

Preparation of a Lubricating Oil Composition

To the motor oil formulation set forth in Table 2 was added an additional 0.1 wt. % of Solvent Neutral 150 base oil along with 50 ppm ferric naphthenate to form a lubricating oil composition.

Testing

Each of the lubricating oil compositions of Example 2 and Comparative Example A were evaluated using the Thermo-Oxidation Engine Oil Simulation Test (TEOST) and Pressurized Differential Scanning Calorimetry (PDSC) test as described below.

Mid-High Temperature Thermo-Oxidative Engine Oil Simulation Test

The Mid-High Temperature Thermo-oxidative Engine Oil Simulation Test (MHT TEOST) was performed to determine the deposit forming tendencies of the motor engine oil. The improved thermal deposit control of the additives of this invention in stabilizing the engine oil formulation has been clearly demonstrated by the MHT TEOST. This test determines the mass of deposit formed on a specially constructed steel rod by continuously stressing a repetitive passage of 8.5 ml of test oil under thermal-oxidative and catalytic conditions. The instrument used was manufactured by Tannas Co. and has a typical repeatability of 0.15 (x+16) mg wherein x is the mean of two or more repeated test results. The TEOST test conditions are listed in Table 3. The less the amount of deposits obtained, the better the oxidation stability of the oil. The results of this test are set forth in Table 4.

TABLE 3

TEOST MHT Test Conditions

| Test Parameters | Settings |
|---|---|
| Test duration | 24 hours |
| Rod Temperature | 285° C. |
| Sample size | 8.5 g (mixture of 8.4 g of oil and 0.1 g of catalyst) |
| Sample flow rate | 0.25 g/min |
| Flow rate (dry air) | 10 mL/min |
| Catalyst | Oil soluble mixture containing Fe, Pb, and Sn |

TABLE 4

TEOST Results

| Ex./Comp. Ex. | mg deposits |
|---|---|
| Example 2 | 34 |
| Comp. Ex. A | 108 |

It can be seen from the above data that the addition of a thio-functionalized phenylenediamine to a lubricating oil composition significantly reduces the total deposit mass of the base blend formulation.

Pressurized Differential Scanning Calorimetry (PDSC)

The PDSC measures the relative oxidation induction time (OIT) of antioxidants in a lubricating oil composition as measured in $O_2$ gas under pressure. The PDSC instrument used is a Mettler DSC27HP manufactured by Mettler-Toledo, Inc (Switzerland). The PDSC method employs a steel cell under constant oxygen pressure throughout each run. The instrument has a typical repeatability of ±2.5 minutes with 95 percent confidence over an OIT of 100 minutes. The PDSC test conditions are given in Table 5. At the beginning of a PDSC run, the steel cell is pressurized with oxygen and heated at a rate of 40° C. per minute to the prescribed isothermal temperature. The induction time is measured from the time the sample reaches its isothermal temperature until the enthalpy change is observed. The longer the oxidation induction time, the better the oxidation stability of the oil. The OIT results of the lubricating oil compositions of Example 2 and Comparative Example A are set forth in Table 6.

TABLE 5

PDSC Test Conditions

| Test Parameters | Settings |
|---|---|
| Temperature | 200° C. |
| Gas | Oxygen |
| Flow Rate | 100 mL/minute |
| Pressure | 500 psi |
| Sample Size | 1-5 mg |
| Pan(open/closed) | open |

TABLE 6

PDSC Results

| Ex./Comp. Ex. | Time, minutes |
|---|---|
| Example 2 | 13.5 |
| Comp. Ex. A | 4.5 |

It can be seen from the above data that a lubricating oil composition containing the thio-functionalized phenylenediamine compound within the scope of the present invention exhibited significantly better oxidative stability than a lubricating oil composition containing no antioxidant.

It will be understood that various modifications may be made to the embodiments disclosed herein. Therefore the above description should not be construed as limiting, but merely as exemplifications of preferred embodiments. For example, the functions described above and implemented as the best mode for operating the present invention are for illustration purposes only. Other arrangements and methods may be implemented by those skilled in the art without departing from the scope and spirit of this invention. Moreover, those skilled in the art will envision other modifications within the scope and spirit of the claims appended hereto.

What is claimed is:

1. A lubricating oil composition comprising (a) at least one oil of lubricating viscosity and (b) an effective amount of at least one thio-functionalized phenylenediamine compound of the general formula:

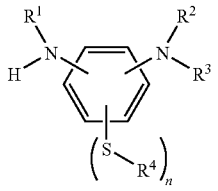

wherein $R^1$ is a straight or branched, substituted or unsubstituted, $C_1$-$C_{30}$ alkyl, a substituted or unsubstituted $C_3$-$C_{30}$ cycloalkyl, a substituted or unsubstituted $C_3$-$C_{30}$ cycloalkenyl, a substituted or unsubstituted $C_5$-$C_{30}$ aryl, a substituted or unsubstituted $C_5$-$C_{30}$ arylalkyl, a substituted or unsubstituted $C_5$-$C_{30}$ heteroaryl, a substituted or unsubstituted $C_3$-$C_{30}$ heterocyclic ring or a $C_1$-$C_{20}$ ester;

$R^2$ and $R^3$ together with the nitrogen atom to which they are bonded are joined together to form a heterocyclic group optionally containing one or more additional heterocyclic atoms;

$R^4$ is independently a straight or branched, substituted or unsubstituted, $C_1$-$C_{30}$ alkyl, a substituted or unsubstituted $C_3$-$C_{30}$ cycloalkyl, a substituted or unsubstituted $C_3$-$C_{30}$ cycloalkenyl, a substituted or unsubstituted $C_5$-$C_{30}$ aryl, a substituted or unsubstituted $C_5$-$C_{30}$ arylalkyl, a substituted or unsubstituted $C_5$-$C_{30}$ heteroaryl, a substituted or unsubstituted $C_3$-$C_{30}$ heterocyclic ring or a $C_1$-$C_{20}$ ester, and n is 1.

2. The lubricating oil composition of claim 1, wherein $R^1$ is a substituted or unsubstituted $C_5$-$C_{30}$ aryl.

3. The lubricating oil composition of claim 1, wherein $R^1$ is a substituted or unsubstituted phenyl group.

4. The lubricating oil composition of claim 1, further comprising least one lubricating oil additive selected from the group consisting of anti-wear agents, detergents, rust inhibitors, dehazinq agents, demulsifyinq agents, metal deactivating agents, friction modifiers, pour point depressants, antifoaming agents, co-solvents, package compatibilisers, corrosion-inhibitors, ashless dispersants, dyes, and extreme pressure agents.

5. The lubricating oil composition of claim 1, wherein the at least one oil of lubricating viscosity has a viscosity of about 1.5 to about 2000 centistokes (cSt) at 100° C.

6. The lubricating oil composition of claim 1, further comprising at least one lubricating oil additive selected from the group consisting of an alkylated diphenylamine, alkylated hindered phenolic, alkylated substituted or unsubstituted phenylenediamine, alkylated oil soluble copper compound, phenothiazines, sulfurized olefins, thiocarbamates, sulfur bearing hindered phenolics, zinc dialkyldithiophosphates.

7. A lubricating oil composition comprising (a) at least one oil of lubricating viscosity and (b) an effective amount of at least one thio-functionalized phenylenediamine compound of the general formula:

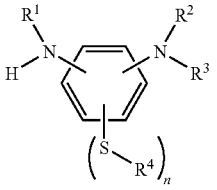

wherein $R^1$ is a straight or branched, substituted or unsubstituted, $C_1$-$C_{30}$ alkyl, a substituted or unsubstituted $C_3$-$C_{30}$ cycloalkyl, a substituted or unsubstituted $C_3$-$C_{30}$ cycloalkenyl, a substituted or unsubstituted $C_5$-$C_{30}$ aryl, a substituted or unsubstituted $C_5$-$C_{30}$ arylalkyl, a substituted or unsubstituted $C_5$-$C_{30}$ heteroaryl, a substituted or unsubstituted $C_3$-$C_{30}$ heterocyclic ring or a $C_1$-$C_{20}$ ester;

$R^2$ and $R^3$ are independently hydrogen, a straight or branched, substituted or unsubstituted, $C_1$-$C_{30}$ alkyl, a substituted or unsubstituted $C_3$-$C_{30}$ cycloalkyl, a substituted or unsubstituted $C_3$-$C_{30}$ cycloalkenyl, a substituted or unsubstituted $C_5$-$C_{30}$ aryl, a substituted or unsubstituted $C_5$-$C_{30}$ arylalkyl, a substituted or unsubstituted $C_5$-$C_{30}$ heteroaryl, a substituted or unsubstituted $C_3$-$C_{30}$ heterocyclic ring or a $C_1$-$C_{20}$ ester with the proviso that only one of $R^2$ and $R^3$ can be hydrogen or $R^2$ and $R^3$ together with the nitrogen atom to which they are bonded are joined together to form a heterocyclic group optionally containing one or more additional heterocyclic atoms; $R^4$ is independently a straight or branched, substituted or unsubstituted, $C_1$-$C_{30}$ alkyl, a substituted or unsubstituted $C_3$-$C_{30}$ cycloalkyl, a substituted or unsubstituted $C_3$-$C_{30}$ cycloalkenyl, a substituted or unsubstituted $C_5$-$C_{30}$ aryl, a substituted or unsubstituted $C_5$-$C_{30}$ arylalkyl, a substituted or unsubstituted $C_5$-$C_{30}$ heteroaryl, a substituted or unsubstituted $C_3$-$C_{30}$ heterocyclic ring or a $C_1$-$C_{20}$ ester, and n is 2.

8. The lubricating oil composition of claim 7, wherein $R^1$ is a substituted or unsubstituted $C_5$-$C_{30}$ aryl.

9. The lubricating oil composition of claim 7, wherein $R^1$ is a substituted or unsubstituted $C_5$-$C_{30}$ aryl, $R^2$ is hydrogen, $R^3$ is a straight or branched, substituted or unsubstituted, $C_1$-$C_{30}$ alkyl.

10. The lubricating oil composition of claim 7, wherein $R^1$ is a substituted or unsubstituted phenyl group, $R^2$ is hydrogen, $R^3$ is a straight or branched $C_1$-$C_6$ alkyl.

11. The lubricating oil composition of claim 7, wherein $R^2$ and $R^3$ together with the nitrogen atom to which they are bonded are joined together to form a heterocyclic group, optionally containing one or more additional heterocyclic atoms.

12. The lubricating oil composition of claim 7, wherein the at least one oil of lubricating viscosity has a viscosity of about 1.5 to about 2000 centistokes (cSt) at 100° C.

13. The lubricating oil composition of claim 7, further comprising at least one lubricating oil additive selected from the group consisting of anti-wear agents, detergents, rust inhibitors, dehazing agents, demulsifying agents, metal deactivating agents, friction modifiers, pour point depressants, antifoaming agents, co-solvents, package compatibilisers, corrosion-inhibitors, ashless dispersants, dyes, and extreme pressure agents.

14. The lubricating oil composition of claim 7, further comprising at least one lubricating oil additive selected from the group consisting of an alkylated diphenylamine, alkylated hindered phenolic, alkylated substituted or unsubstituted phenylenediamine, alkylated oil soluble copper compound, phenothiazines, sulfurized olefins, thiocarbamates, sulfur bearing hindered phenolics, and zinc dialkyldithiophosphates.

* * * * *